US007448531B1

(12) United States Patent
Bolles

(10) Patent No.: US 7,448,531 B1
(45) Date of Patent: Nov. 11, 2008

(54) THEFT-RESISTANT MAILBOX WITH SECURE MOUNTING BRACKET AND METHOD OF CONSTRUCTION THEREOF

(76) Inventor: David Joseph Bolles, 2005 E. Lake Sammamish Pl. SE., Sammamish, WA (US) 98075

( * ) Notice: Subject to any disclaimer, the term of this patent is extended or adjusted under 35 U.S.C. 154(b) by 308 days.

(21) Appl. No.: 11/440,644

(22) Filed: May 24, 2006

Related U.S. Application Data

(60) Provisional application No. 60/684,787, filed on May 26, 2005.

(51) Int. Cl.
*A47G 29/12* (2006.01)

(52) U.S. Cl. ..... 232/39; 248/146; 248/219.2; 248/223.41

(58) Field of Classification Search ..... 232/39, 232/38, 17; 248/146, 219.2, 220.21, 220.22, 248/223.41
See application file for complete search history.

(56) References Cited

U.S. PATENT DOCUMENTS

| | | | | |
|---|---|---|---|---|
| 2,552,915 | A | 5/1951 | Zachrich | |
| 4,893,747 | A * | 1/1990 | Roth | 232/39 |
| 5,337,954 | A | 8/1994 | Kobilarcik et al. | |
| 5,386,938 | A | 2/1995 | West | |
| 5,400,958 | A * | 3/1995 | Walker | 232/39 |
| 5,664,748 | A | 9/1997 | Speece et al. | |
| 6,474,543 | B2 | 11/2002 | Grell | |
| 6,722,561 | B1 | 4/2004 | Tomas et al. | |
| 7,163,141 | B1 * | 1/2007 | Parker | 232/39 |
| 7,195,146 | B1 * | 3/2007 | Dunn et al. | 232/39 |
| 7,249,704 | B1 * | 7/2007 | Smith | 232/39 |
| 2005/0127259 | A1 * | 6/2005 | Riker | 248/219.2 |

* cited by examiner

*Primary Examiner*—William L. Miller
(74) *Attorney, Agent, or Firm*—Patrick J. S. Inouye; Krista A. Wittman

(57) ABSTRACT

A theft-resistant mailbox with secure mounting bracket and method of construction thereof are presented. A mounting bracket is formed and includes a substantially flat plate provided with one or more apertures to accommodate at least one post fastener. A housing having an open substantially rectangular bottom is provided. A bottom plate is fixedly attached to the inside walls of the housing above bottom margins of the rectangular bottom. A bracket mount is provided between the bottom margins to be slidably received by the mounting bracket over the post fastener. A lockable door is pivotably attached to a front of the housing. A bracket lock is provided to removably lock the mounting bracket to the housing from at least one fixed point of attachment accessible from within the housing.

36 Claims, 7 Drawing Sheets

THEFT-RESISTANT MAILBOX WITH SECURE MOUNTING BRACKET AND METHOD OF CONSTRUCTION THEREOF

CROSS-REFERENCE TO RELATED APPLICATION

This non-provisional patent application claims priority under 35 U.S.C. § 119(e) to commonly-owned U.S. provisional patent application Ser. No. 60/684,787, filed May 26, 2005, the disclosure of which is incorporated by reference.

FIELD OF THE INVENTION

The invention relates in general to mailbox mounting brackets and, in particular, to a theft-resistant mailbox with secure mounting bracket and method of construction thereof.

BACKGROUND OF THE INVENTION

Recently, an increase in theft and overall concerns of personal security have drawn into question the wisdom of relying on non-locking mailboxes for curbside mail delivery. Mail delivered by a postal carrier is often left unguarded for hours or even days at a time. Valuable correspondence, such as bank statements, negotiable instruments, and credit cards, are placed at risk of being stolen, particularly in light of a rising trend in identity theft.

Providing a locking mechanism on mailboxes provides a partial solution. A lock ensures mail is securely stored and access is limited. However, a locking mechanism is only effective provided that the entire mailbox is not stolen, such as where a thief, out of desperation or expediency, removes the entire mailbox assembly by jimmying or breaking the mailbox from the mounting. Moreover, the awkward shape and limited space afforded by the interior of a mailbox makes the use of robust concealed fasteners difficult. Similarly, one-way screws can make removal difficult, should servicing be later required.

For example, U.S. Pat. No. 6,722,561, issued Apr. 20, 2004 to Tomas et al., discloses a locking mailbox with a vertically-oriented housing. The mailbox is preferably constructed from durable plastic and can be directly mounted onto a mounting post. Post fasteners accessible through the interior vertically attach the mailbox to a post, but the mailbox is oddly shaped and incompatible with widely used horizontal mounting surfaces.

U.S. Pat. No. 6,474,543, issued Nov. 5, 2002 to Grell, discloses a mailbox that defines an arcuate chamber. Decorative articles or liquids can be placed within the chamber. The mailbox is removably attached to a support post using a rectangular base plate that is slidably couples to a horizontal mounting bracket. A tab snappably engages the bracket when the mailbox is properly seated and can be further secured with a padlock. However, the base plate is a structure separate from the mailbox and exposes the bracket to compromise and breakage.

U.S. Pat. No. 5,664,748, issued Sep. 9, 1997 to Speece et al., discloses a universal mounting base for securing multiple sizes of mailboxes to a variety of post mounting configurations. Oppositely disposed sidewalls define extended mounting flanges with a recessed bottom facing inwardly. A molded mounting bracket provides multiple support parts and arm engagement areas. In addition, the mounting flanges have apertures to facilitate mounting using exposed fasteners, which are susceptible to breakage and compromise.

U.S. Pat. No. 5,386,938, issued Feb. 7, 1995 to West, discloses a mailbox post mounting with a frame for securing a mailbox on an upright square or rectangular post. A pair of parallel brackets receives the ends of a pair of bars that are mounted at right angles to form a rectangular frame. Each bar includes holes for fastening the mount to a post. The brackets include apertures for mounting the mailbox. The complete mounting is formed of four separate non-integral parts susceptible to breakage and exposure.

U.S. Pat. No. 5,337,954, issued Aug. 16, 1994 to Kobilarcik et al., discloses a mailbox mounting bracket. The bracket includes spaced flanges depending from ribbed members formed on the bottom surface of the bracket to permit mounting onto a stanchion. Lugged members provided on the sidewalls of the bracket are received in apertures in the flanges depending from the bottom wall of the mailbox. The mounting bracket is non-integral and leaves fasteners exposed and susceptible to compromise.

U.S. Pat. No. 2,552,915, issued May 15, 1951 to Zachrich, discloses a rural mailbox supporting bracket, which includes a base plate, a pair of bracket members, and two pairs of post clamps. The base plate is substantially oblong with opposite side portions bent downwardly to form lateral flanges disposed to be fit within the post clamps. The mailbox is secured to the supporting bracket by outwardly disposed fasteners that are susceptible to breakage and theft.

Therefore, there is a need for a secure mounting that provides unencumbered access to mounting hardware, yet can become a unitary part of a mailbox without sacrificing ease of removal or maintenance.

SUMMARY OF THE INVENTION

A robustly-mountable bracket is provided as an integral yet separable part of a secure mailbox assembly. The bracket is configured with one or more apertures to accommodate post fasteners to robustly attach the bracket to a mounting post or other level surface. During installation, access to the apertures remains unencumbered to facilitate stout fastening to the mounting surface. The mailbox assembly is slidably received onto the bracket once mounting is complete. The mailbox assembly is secured to the bracket through concealable housing fasteners or tabs that provide a bracket lock that can only be accessed through a securable enclosure. The housing fasteners or tabs can be part of either the bracket or mailbox assembly, or can be separate components.

One embodiment provides a theft-resistant mailbox with secure mounting bracket and method of construction thereof. A mounting bracket is formed and includes a substantially flat plate provided with one or more apertures to accommodate at least one post fastener. A housing having an open substantially rectangular bottom is provided. A bottom plate is fixedly attached to the inside walls of the housing above bottom margins of the rectangular bottom. A bracket mount is provided between the bottom margins to be slidably received by the mounting bracket over the post fastener. A lockable door is pivotably attached to a front of the housing. A bracket lock is provided to removably lock the mounting bracket to the housing from at least one fixed point of attachment accessible from within the housing.

A further embodiment provides mounting bracket for a theft-resistant mailbox. A mounting bracket assembly is built and includes a substantially flat plate provided with one or more apertures to accommodate at least one concealable post fastener. A bracket lock is attached. A mailbox housing can be slidably received by the mounting bracket assembly over the post fastener to removably lock the mounting bracket to the housing with the bracket lock from at least one fixed point of attachment accessible from within the housing.

The mounting bracket in combination with the bracket lock provide several benefits. First, prior to slidably receiving a mailbox assembly, the mounting bracket is a separate component, which enables the mailbox to be easily installed without having to operate tools on post fasteners from within the mail storage enclosure. Following receipt of the mailbox assembly, the post fasteners are concealed by the bottom plate of the mailbox. In addition, the bracket lock, which locks the mailbox assembly to the mounting bracket, is only accessible from within the mail storage enclosure and remains secure from compromise or breakage while the mailbox remains locked. The mounting bracket becomes an integral part of the mailbox and no fasteners are exposed on the outside of the mailbox. Finally, a homeowner can easily remove the mailbox from the mounting bracket for maintenance or reinstallation at a new location that uses a compatible mounting bracket.

Still other embodiments of the invention will become readily apparent to those skilled in the art from the following detailed description, wherein are described embodiments of the invention by way of illustrating the best mode contemplated for carrying out the invention. As will be realized, the invention is capable of other and different embodiments and its several details are capable of modifications in various obvious respects, all without departing from the spirit and the scope of the invention. Accordingly, the drawings and detailed description are to be regarded as illustrative in nature and not as restrictive.

DETAILED DESCRIPTION

Theft-Resistant Mailbox With Secure Mounting Bracket

Figure 1:
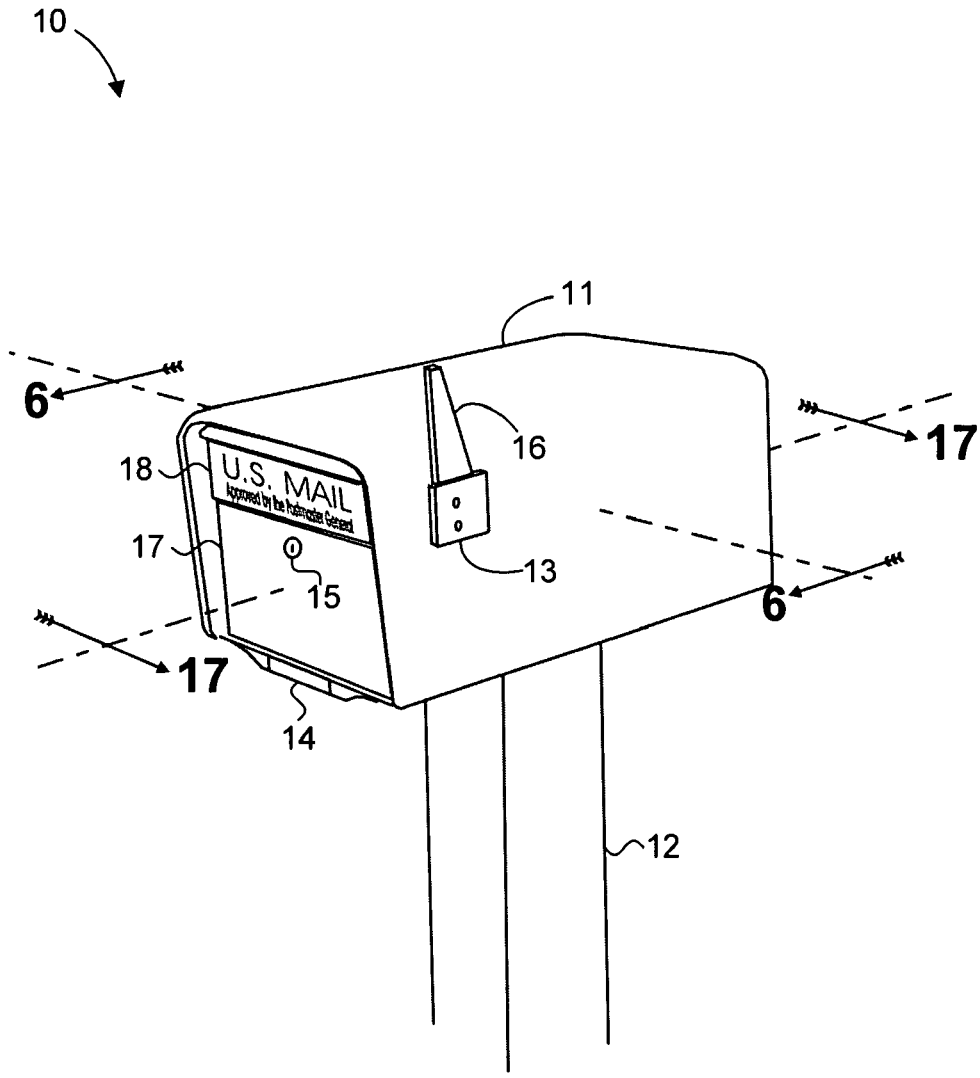
FIG. 1 is a perspective view showing, by way of example, a theft-resistant mailbox with secure mounting bracket, in accordance with one embodiment.

Conventionally, mailboxes are frequently installed on a mounting post or other level surface to permit easy curbside access by postal delivery vehicles and mail carriers. FIG. 1 is a perspective view showing, by way of example, a theft-resistant mailbox 10 with secure mounting bracket 14, in accordance with one embodiment. The bracket 14 can be robustly secured to a mounting post 12, or other level or horizontal surface, through internally accessible post fasteners. Following mounting, the bracket 14 becomes an integral part of the mailbox 10.

The mailbox 10 includes a housing 11, which forms an enclosure for storing mail and other articles. An ornamental design of a mailbox assembly suitable for use as the mailbox 10 is described in commonly-owned U.S. Design patent application, Ser. No. 29/260,448, filed May 24, 2006, abandoned, and U.S. Design patent application, Ser. No. 29/297,960, filed Nov. 23, 2007, pending, the disclosures of which are incorporated by reference. The housing 11 is formed in an inverted U-shape, to which a rear wall is fixedly attached. A bottom plate is fixedly attached to the interior of the housing 11 during assembly to provide a floor. One or more doors are attached to the front of the housing 11. The front generally means the side of the mailbox 10 by which mail is received through the doors. The mounting bracket 14 slidably fits between the two inside walls of the housing 11 along the bottom edge. The mailbox 10 also includes a lockable mail delivery door 17 and non-lockable mail receipt door 18, which are pivotably mounted on the front. The lockable door 17 prevents access to delivered mail or articles, except by those individuals having a key to operate a locking mechanism 15. A locking mechanism suitable for use with the mailbox 10 is described in commonly-owned U.S. Provisional Patent application, Ser. No. 60/808,469, filed May 24, 2006, converted, and U.S. patent application, Ser. No. 11/805,995, filed May 24, 2007, pending, the disclosures of which are incorporated by reference. The non-lockable door 18 allows mail carriers and other individuals to deliver mail and other articles into the mailbox 10 and to retrieve items left for pickup. Access to mail or articles that have already been delivered is prevented by an internal mail delivery chute, as further described below with reference to FIG. 7. Finally, the mailbox 10 includes an outgoing mail pick-up flag 16 that can be operated through a pivotable mounting 13.

Figure 2:
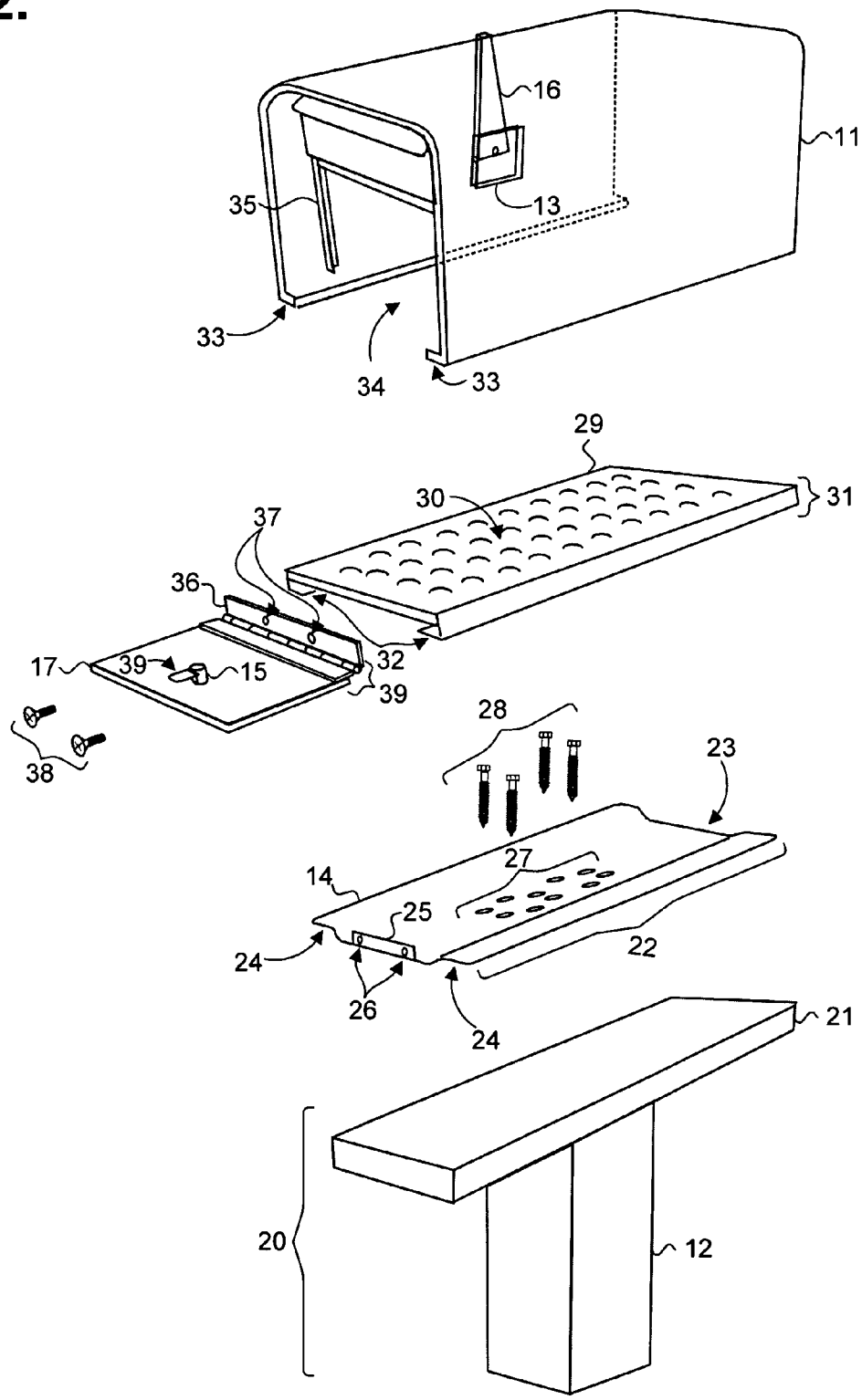
FIG. 2 is an exploded perspective view showing the theft-resistant mailbox with secure mounting bracket of FIG. 1.

The mailbox 10 provides a theft-resistant enclosure, which can be robustly installed on a mounting post or other level surface without exposing mounting hardware to breakage or compromise. FIG. 2 is an exploded perspective view showing the theft-resistant mailbox 10 with secure mounting bracket 14 of FIG. 1. The bracket 14 fixably attaches the mailbox 10 as an assembly to a stationary mounting assembly 20, which can be an upright post 12, a horizontal beam 21, or other level surface. The horizontal beam 21 can be affixed to the upright post 12 or provided as a separate piece. The bracket 14 is a substantially flat plate provided with one or more apertures 27 to accommodate post fasteners 28. The bracket 14 is fixedly attached to the stationary mounting assembly 20 before slidably receiving the mailbox assembly. Access to the bracket 14 is unconstrained and permits the free use of tools unencumbered by a surrounding enclosure. The post fasteners 28 can include, for example, free fasteners, such as screws, bolts, nails, staples, and the like, that are driven through the apertures 27 to affix the bracket to the stationary mounting assembly 20. In a further embodiment, the post fasteners 28 can include fasteners, which are fixed or integral to the bracket 14 or stationary mounting assembly 20 and that are securely coupled respectively to the stationary mounting assembly 20 or bracket 14. In a still further embodiment, the post fasteners 28 can include welding and other forms of permanent installation. Still other types or combinations of post fasteners are possible.

After the bracket 14 has been affixed to the stationary mounting assembly 20, the housing 11 is slidably positioned over the bracket 14. The bracket 14 is sized to be conformably received between the inside walls of the housing 11. The bottom margin of the bottom edges of the housing 11 is formed into a pair of guides 33 that face inwards and run perpendicular to the bottom edges of the housing 11. When the housing is slid onto the bracket 14, the housing guides 33 wrap around the edges 22 of the bracket 14.

A bottom plate 29 is mounted near the bottom of the housing 11 to form a central enclosure 34 within which contents may be stored. Each edge of the bottom plate 29 defines a lip 31 that is fixedly attached to the inwardly facing walls of the housing 11 through, for example, spot welding, rivets, adhesives, and the like. In addition, the bottom edges of the bottom plate 29 are formed into a further pair of guides 32, which also face inwards and run perpendicular to each lip 31. When the bottom plate 29 is fixedly attached to the housing 11, a gap is provided between the housing guides 33 and the bottom plate guides 32 to form a pair of parallel channels, which serve as a bracket mount by which the edges 22 of the bracket 14 are slidably received. Other types of bracket mounts are possible, such as further described below beginning with reference to FIGS. 8-13. In a further embodiment, a set of raised dimples 30 or indentations are formed on the top surface of the bottom plate 29. Other arrangements and configurations of bottom plates are possible.

The bracket 14 is formed to define a flat center portion 23 and elevated side portions 24 that run the length of the bracket 14 parallel to the sides 22. The elevation enables a wider range of post fasteners 28 to be used by providing clearance between the bottom plate 29 and center portion 23. As the bottom plate 29 is fixedly attached to the inside walls of the housing 11 prior to the housing 11 being slidably received onto the bracket 14, the bottom plate 29 covers and securely conceals the post fasteners 28.

The mailbox assembly, which includes at least the housing 11 and bottom plate 29, is attached to the bracket 14 through a bracket lock that is only accessible from within the enclosure 34. When the lockable door 17 is closed and locked, the mailbox 10 is secure and the combination of robust mounting hardware and concealed bracket lock provide a superior degree of theft resistance. The bracket lock can be part of either the bracket 14, housing 11, bottom plate 29, or other mailbox component, or can be a separate component. For example, the bracket 14 can include a fastener tab 25 that is formed on a leading edge of the bracket 14. Other types of fastener tabs are possible, such as further described below beginning with reference to FIGS. 14-17. The tab 25 provides one or more apertures 26 to admit a housing fastener 38. A crosstie 36 is sized to span the front opening of the housing 11 and provides one or more further apertures 37 that each line up with the apertures 26 on the bracket tab 25. The crosstie 36 is fixedly attached to the inside walls of the housing 11 in front of and preferably against the bottom plate 29. The crosstie 36 can include a hinge assembly 39 to pivotably attach the lockable door 17 to the housing 11.

When the housing 11 is slidably fit over the bracket 14, the bracket tab 25 abuts the crosstie 36. The housing fasteners 38 are admitted through the bracket tab apertures 26 and crosstie apertures 37 to secure the housing 11 to the bracket 14. The housing fasteners 38 can include, for example, screws, rivets, bolts, and the like, and can be provided as free components or components fixed or integral to either of the crosstie 36 or tab 25. Other types of fasteners are possible. When the lockable door 17 is closed, the locking mechanism 15 engages a frame 35 fixedly attached to the housing 11. The post fasteners 28 and housing fasteners 38 are thereby concealed and secure from compromise or breakage to lock the housing 11 to the mounting bracket 14.

Mounting Bracket

Figure 3:
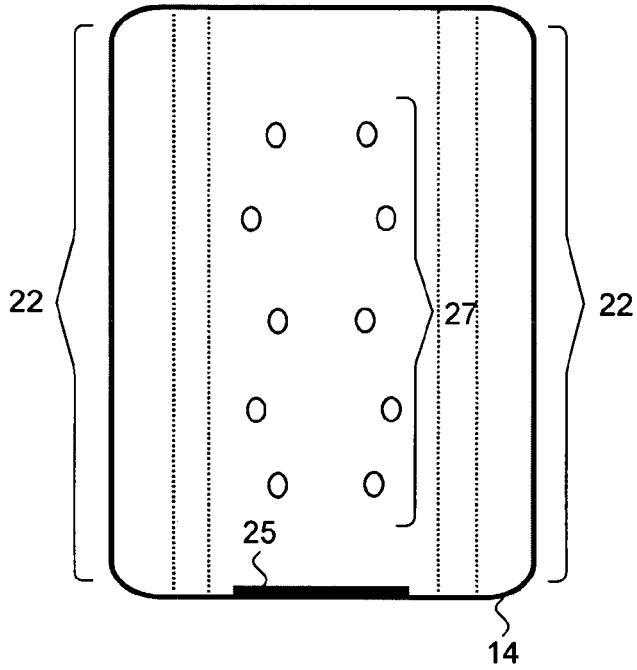
FIG. 3 is a top plan view showing a secure mounting bracket of FIG. 1.

When slidably secured into the housing 11, the bracket 14 becomes an integral part of the mailbox 10. FIG. 3 is a top plan view showing a secure mounting bracket 14 of FIG. 1. The edges 22 along the side of the bracket 14 are formed to conformably fit within the inside walls of the housing 11. The bracket tab 25 is preferably formed perpendicular to the center portion 23 of the bracket 14 along the leading edge. The apertures 27 for accommodating the post fasteners 28 are provided about the center portion 23 and can be arranged and sized to accommodate a range of fastener configurations and types.

Figure 4:
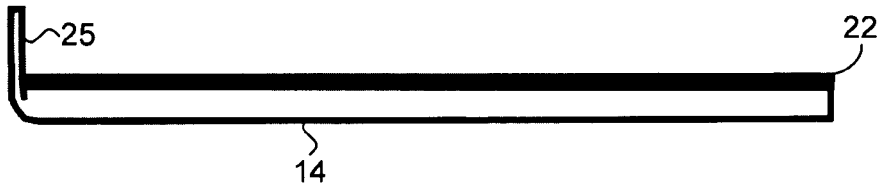
FIG. 4 is a side elevational view showing a secure mounting bracket of FIG. 1.

The bracket 14 is sized to fit within the footprint of the bottom of the housing 11. FIG. 4 is a side elevational view showing a secure mounting bracket 14 of FIG. 1. The bracket tab 25 and bracket edges 22 respectively contact the mailbox in transverse and longitudinal orientations to provide fixed points of attachment along three of the four margins of the bottom of the housing 11. In a further embodiment, a second tab (not shown) can be defined on the back edge of the bracket 14 or on the housing 11 to provide fixed points of attachment around the entire bracket 14.

Figure 5:
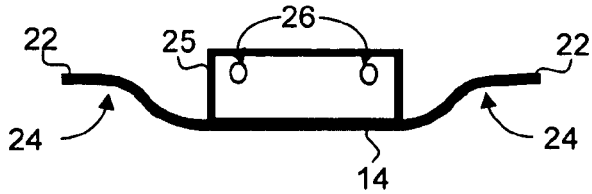
FIG. 5 is a front elevational view showing a secure mounting bracket of FIG. 1.

Prior to securing the mailbox 10, the bracket 14 is a separate component that allows unencumbered access to the mounting points of the post fasteners 28 to the stationary mounting assembly 20. FIG. 5 is a front elevational view showing a secure mounting bracket 14 of FIG. 1. The elevated sections 24 formed parallel to the edges 22 create a recessed area in the center section 23 behind the bracket tab 25 to provide ample clearance for the post fasteners 28. The tab apertures 26 are provided no lower than the tops of the elevated sections 24 to ensure that the housing fasteners 38 will remain concealed from view and access once the housing 11 is secured to the bracket 14.

Figure 6:
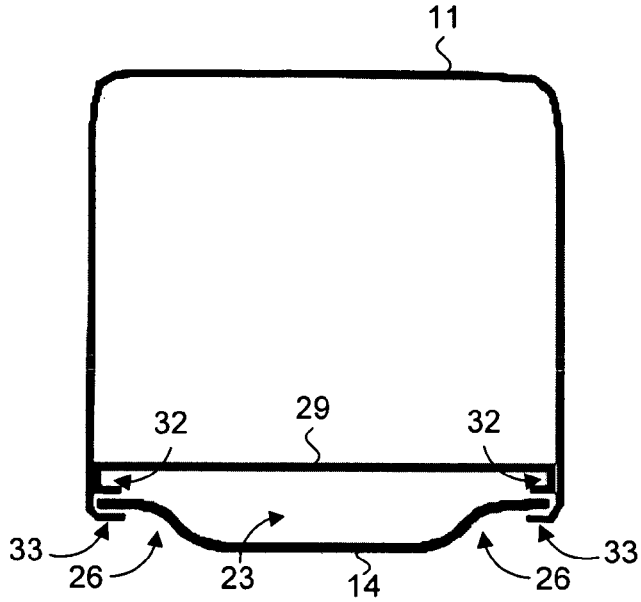
FIG. 6 is a transverse cross-sectional view showing the theft-resistant mailbox with secure mounting bracket of FIG. 1.

Following mounting, the bracket 14 slidably receives the housing 11. FIG. 6 is a transverse cross-sectional view showing the theft-resistant mailbox 10 with secure mounting bracket 14 of FIG. 1. The housing guides 33 and the bottom plate guides 32 define a channel by which the edges 22 of the bracket 14 are slidably received. The spacing between the housing guides 33 and bottom plate guides 32 should be at least as wide as the thickness of the bracket 14, but should not be spaced so widely as to allow the mailbox 10 be unsteady.

Figure 7:
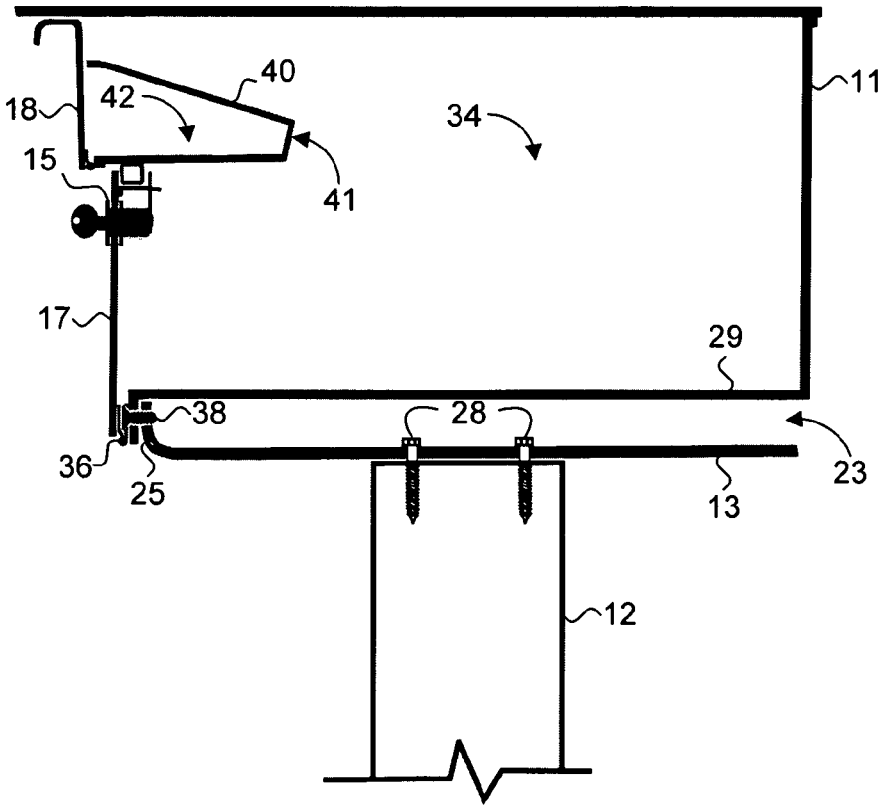
FIG. 7 is a longitudinal cross-sectional view showing the theft-resistant mailbox with secure mounting bracket of FIG. 1.

The mailbox 10 includes two compartments for receiving incoming and outgoing mail and articles. FIG. 7 is a longitudinal cross-sectional view showing the theft-resistant mailbox 10 with secure mounting bracket 14 of FIG. 1. The enclosure 34 provides a primary storage compartment for delivered mail and articles, which are stored securely behind the lockable door 17. A shelf 40 attached to the inside walls of the housing 11 above the lockable door frame 35 serves two purposes. First, the shelf 40 defines a sub-enclosure 42 within which outgoing mail and articles can be placed for pick-up. Second, a chute 41 is defined along the back wall of the shelf 40 to admit passage of delivered mail and articles, yet encumber attempts to reach into or otherwise access the central enclosure 34. Other arrangements and configurations of enclosures are possible.

The housing 11, lockable door 17, non-lockable door 18, bottom plate 22, and bracket 14 can be manufactured from 2.0 mm galvanized steel with a powder coat paint finish. In a further embodiment, 1.5 mm stainless steel can be used in place of galvanized steel. The hinge assembly 39 is preferably stainless steel to prevent corrosion. Other materials, thicknesses, and finishes are possible.

FURTHER EMBODIMENTS

Figure 8:
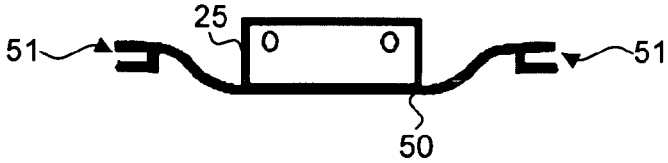
FIG. 8 is a front elevational view showing a secure mounting bracket, in accordance with a further embodiment.

The channels can be provided on the bracket instead of on the housing. The spacing between the housing guides 33 and bottom plate guides 32 form parallel channels by which the edges 22 of the bracket 14 are slidably received. FIG. 8 is a front elevational view showing a secure mounting bracket 50, in accordance with a further embodiment. The edges of the bracket 50 are formed to define a pair of parallel channels 51 along the edges 22, which can be used in place of the parallel channels formed by the spacing between the housing guides 33 and the bottom plate guides 32.

Figure 9:
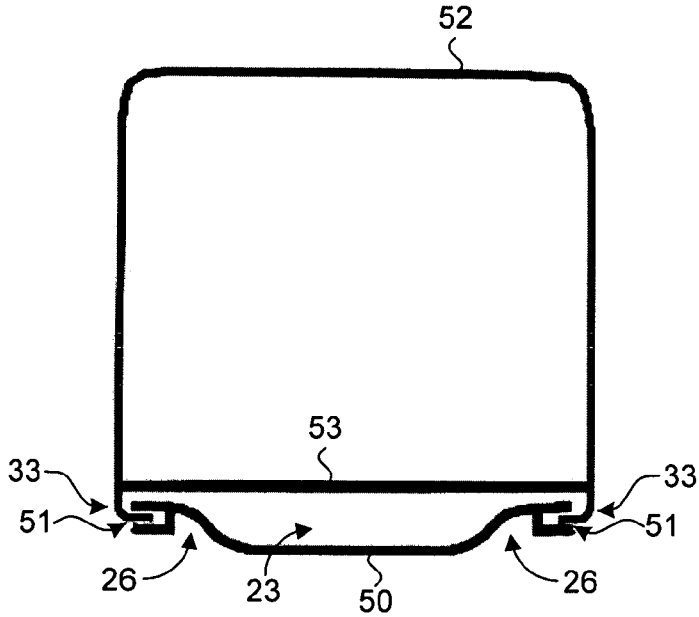
FIG. 9 is a transverse cross-sectional view showing a theft-resistant mailbox with secure mounting bracket, in accordance with a further embodiment.

Relocating the parallel channels from the mailbox to the bracket can simplify the structure of the bottom plate 29. FIG. 9 is a transverse cross-sectional view showing a theft-resistant mailbox 10 with secure mounting bracket 50, in accordance with a further embodiment. The housing guides 33 are slidably fit into the bracket guides 51. A simplified bottom plate 53 can be attached to or formed as an integral part of the housing 52.

Figure 10:
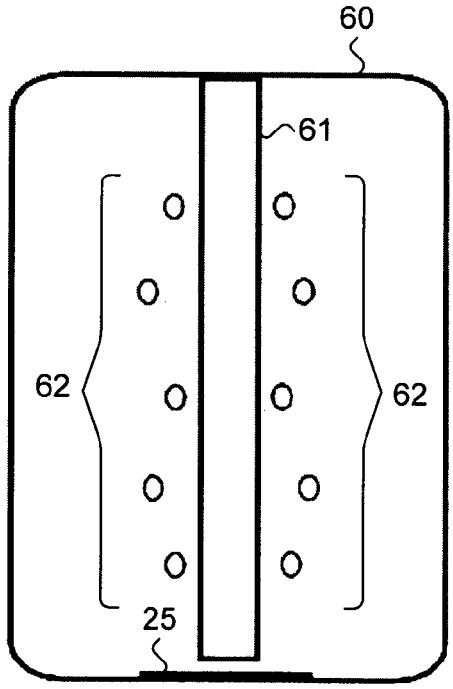
FIG. 10 is a top plan view showing a secure mounting bracket, in accordance with another further embodiment.

The bracket also need not be secured to the mailbox exclusively along the inside walls of the housing. FIG. 10 is a top plan view showing a secure mounting bracket 60, in accordance with another further embodiment. A T-shaped guide 61 is provided longitudinal and parallel to the sides of the bracket 60. Apertures 62 are provided on either side of the T-shaped guide 61.

Figure 11:
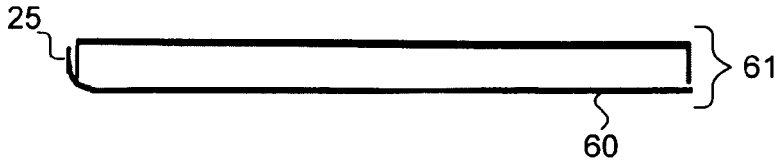
FIG. 11 is a side elevational view showing a secure mounting bracket, in accordance with another further embodiment.

The T-shaped guide 61 can be provided as a substitute for or in addition to the mounting functionality of the channels. FIG. 11 is a side elevational view showing a secure mounting bracket 60, in accordance with another further embodiment. The back edge of the T-shaped guide 61 includes a stop that prevents further rearward longitudinal movement of the housing 11 when slid onto the bracket 60. The bracket tab 25 similarly abuts the crosstie 36 for secure fastening.

Figure 12:
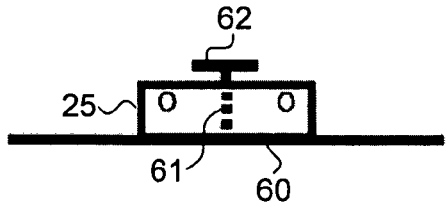
FIG. 12 is a front elevational view showing a secure mounting bracket, in accordance with another further embodiment.

The T-shaped guide 61 permits greater flexibility in the interface between the bracket 60 and the stationary mounting assembly 20. FIG. 12 is a front elevational view showing a secure mounting bracket 60, in accordance with another further embodiment. The surface of the bracket 60 can be substantially flat to accommodate post fasteners over the entire flat surface of the bracket 60. The top surface 62 of the T-shaped guide 61 is elevated over the top surface of the bracket 60 to provide clearance for the post fasteners 28.

Figure 13:
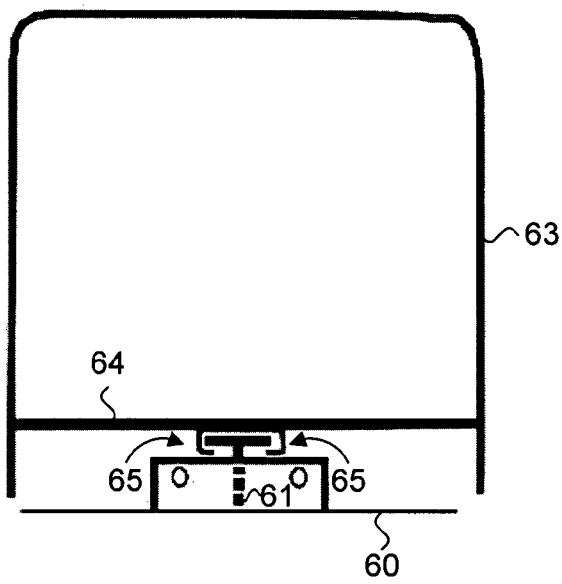
FIG. 13 is a transverse cross-sectional view showing the theft-resistant mailbox with secure mounting bracket, in accordance with another further embodiment.

The bottom plate of the mailbox, rather than the inside walls of the housing, slidably receives the bracket 60. FIG. 13 is a transverse cross-sectional view showing the theft-resistant mailbox with secure mounting bracket 60, in accordance with another further embodiment. A pair of inwardly-facing and parallel C-shaped channel guides 65 are formed on a bottom surface of the bottom plate 64, which can be fixedly attached to or formed as an integral part of a housing 63. The C-shaped channel guides 65 are oriented to facilitate centering of the mailbox 10 over the bracket 60 and alignment of the bracket tab apertures 26 and crosstie apertures 37. The provisioning of the T-shaped guide 61 and C-shaped channel guides 65 can also be interchanged by including a T-shaped guide on the bottom surface of the bottom plate and C-shaped channel guides on the bracket.

Figure 14:
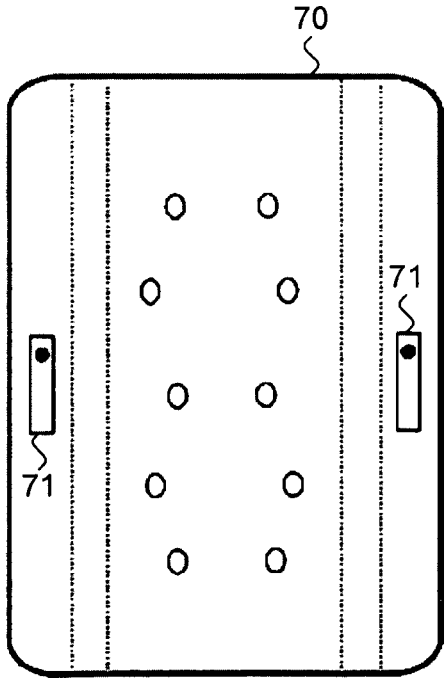
FIG. 14 is a top plan view showing a secure mounting bracket, in accordance with an even further embodiment.

The bracket tab 25 and associated housing fasteners 38 provide a concealable, yet removable bracket lock that secures the mailbox 10 to the bracket. In further embodiments, the bracket lock can be part of either the bracket 14, housing 11, bottom plate 29, or other mailbox component, or can be a separate component. FIG. 14 is a top plan view showing a secure mounting bracket 70, in accordance with an even further embodiment. The bracket tab 25 can be replaced or supplemented with one or more spring-loaded tabs 71, which are received into the bottom plate to secure the mailbox 10 to the bracket 70. The tabs 71 are fixedly attached to the top surface of the mounting bracket 70. However, the tabs 71 could alternatively be fixedly attached to the bottom surface of the bottom plate 29, or could be a separate free component that fits between the bracket 70 and the bottom plate 29.

Figure 15:
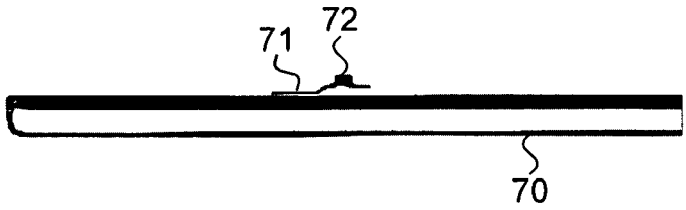
FIG. 15 is a side elevational view showing a secure mounting bracket, in accordance with an even further embodiment.

The spring loading enables each tab 71 to automatically engage the bottom plate as the bracket 70 is slidably received on the mailbox 10 to concealably lock the mailbox assembly to the bracket 70. FIG. 15 is a side elevational view showing a secure mounting bracket 70, in accordance with an even further embodiment. The free end of each spring-loaded tab 71 includes a nub 72 that engageably meets with a corresponding aperture provided on the bottom surface of the bottom plate. When provided on the bottom plate, the nub 72 engageably meets with a corresponding notch or indentation on the bracket 70.

Figure 16:
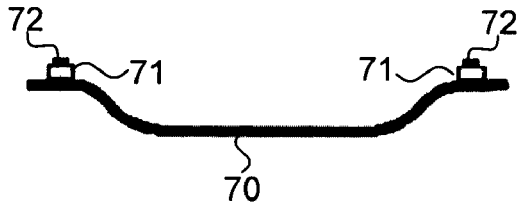
FIG. 16 is a front elevational view showing a secure mounting bracket, in accordance with an even further embodiment.

The mailbox can be released from the bracket by pushing down on each nub 72 through the aperture. FIG. 16 is a front elevational view showing a secure mounting bracket 70, in accordance with an even further embodiment. When depressed through the top of each bottom plate aperture, the nub 72 clears the bottom surface of the bottom plate as the mailbox 10 is slidably removed from the bracket 70. The range of travel provided at the free end of each spring-loaded tab 71 must be sufficient to accommodate the height of each nub 72 and thereby allow disengagement of the bottom plate from the bracket 70. If the nub 72 engageably meets the bottom plate, the nub 72 can be disengaged by providing within the enclosure, for instance, a pull tab, push pin, or pivotable lever on the opposite end of the tab 71.

Figure 17:
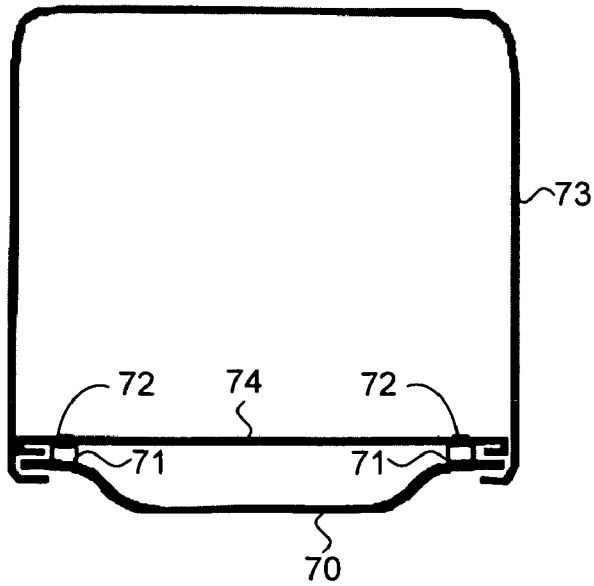
FIG. 17 is a transverse cross-sectional view showing the theft-resistant mailbox with secure mounting bracket, in accordance with an even further embodiment.

The spring-loaded tabs 71 prevent further longitudinal movement by the mailbox 10 as the mailbox 10 is slidably received onto the bracket 70. FIG. 17 is a transverse cross-sectional view showing the theft-resistant mailbox with secure mounting bracket 70, in accordance with an even further embodiment. The edges of the bracket 70 engage the channels formed between the housing guides 73 and the bottom plate guides. Each spring-loaded tab 71 is preferably provided along the elevated section of the bracket 70. However, each spring-loaded tab 71 could also be provided in the center section 23, provided sufficient vertical travel is included. The spring-loaded tabs 71 can be used as a substitute for or in conjunction with the bracket tab and housing fasteners 28. Other mechanisms to slidably receive the mailbox 10 onto a mounting bracket and to concealably secure the mailbox to the mounting bracket are possible.

While the invention has been particularly shown and described as referenced to the embodiments thereof, those skilled in the art will understand that the foregoing and other changes in form and detail may be made therein without departing from the spirit and scope of the invention.

What is claimed is:

1. A theft-resistant mailbox with secure mounting bracket, comprising:

a mounting bracket comprising a substantially flat plate provided with one or more apertures to accommodate at least one post fastener;

a housing having an open substantially rectangular bottom, comprising:

a bottom plate fixedly attached to inside walls of the housing above bottom margins of the rectangular bottom;

a bracket mount provided between the bottom margins to be slidably received by the mounting bracket over the post fastener; and a lockable door pivotably attached to a front of the housing; and a bracket lock to removably lock the mounting bracket to the housing from at least one fixed point of attachment accessible from within the housing.

2. A mailbox according to claim 1, wherein the bracket lock comprises:

a perpendicular flange formed on a leading edge of the mounting bracket with one or more flange apertures; and a crosstie with one or more crosstie apertures and fixedly attached to the inside walls of the housing in front of the bottom plate, wherein the flange apertures and the crosstie apertures are in substantial alignment to receive at least one concealable housing fastener when the housing is slidably received by the mounting bracket.

3. A mailbox according to claim 2, wherein the bracket lock further comprises:

a hinge attached to the lockable door and the crosstie along the front of the housing.

4. A mailbox according to claim 1, wherein the bracket lock comprises:

at least one spring-loaded tab attached on a fixed end to an upper surface of the mounting bracket and comprising a nub formed on a free end; and at least one aperture formed in the bottom plate, wherein the spring-loaded tab nub and the bottom plate aperture are in substantial alignment when the housing is slidably received by the mounting bracket.

5. A mailbox according to claim 1, wherein the bracket lock comprises:

at least one spring-loaded tab attached on a fixed end to a bottom surface of the bottom plate and comprising a nub formed on a free end; and at least one notch formed in an upper surface of the mounting bracket, wherein the spring-loaded tab nub and the mounting bracket notch are in substantial alignment when the housing is slidably received by the mounting bracket.

6. A mailbox according to claim 1, further comprising:

a pair of housing guides formed on the bottom margins to face inwards and run perpendicular to the bottom edges of the housing;

a pair of bottom plate guides formed on bottom edges of the bottom plate to face inwards and run perpendicular to outside edges of the bottom plate; and a pair of parallel channels, which comprises the bracket mount, defined between each of the housing guides and bottom plate guides and sized to slidably receive the mounting bracket.

7. A mailbox according to claim 1, further comprising:

a pair of housing guides, which comprises the bracket mount, formed on the bottom margins to face inwards and run perpendicular to the bottom edges of the housing; and a pair of parallel channels formed on the outside edges of the mounting bracket and sized to slidably receive the housing guides.

8. A mailbox according to claim 1, further comprising:

a pair of parallel C-shaped channel guides, which comprises the bracket mount, formed on a bottom surface of the bottom plate to face inwards; and a T-shaped guide formed on the mounting bracket, wherein the C-shaped channel guides are sized to slidably receive the T-shaped guide.

9. A mailbox according to claim 1, further comprising:

a T-shaped guide, which comprises the bracket mount, formed on a bottom surface of the bottom plate; and a pair of parallel C-shaped channel guides formed on the mounting bracket to face inwards, wherein the T-shaped guide is sized to slidably receive the C-shaped channel guides.

10. A mailbox according to claim 1, further comprising:

a non-lockable door pivotably attached to the front of the housing.

11. A mailbox according to claim 10, further comprising:

a shelf to provide a substantially level surface and sized to fixedly fit within the housing juxtapositioned to the non-lockable door.

12. A method for constructing a theft-resistant mailbox with secure mounting bracket, comprising:

forming a mounting bracket comprising a substantially flat plate provided with one or more apertures to accommodate at least one post fastener;

providing a mailbox housing having an open substantially rectangular bottom, comprising:

fixedly attaching a bottom plate to inside walls of the housing above bottom margins of the rectangular bottom;

providing a bracket mount between the bottom margins to be slidably received by the mounting bracket over the post fastener; and pivotably attaching a lockable door to a front of the housing; and providing a bracket lock to removably lock the mounting bracket to the housing from at least one fixed point of attachment accessible from within the housing.

13. A method according to claim 12, wherein the bracket lock is provided by:

forming a perpendicular flange on a leading edge of the mounting bracket with one or more flange apertures;

providing a crosstie with one or more crosstie apertures; and fixedly attaching the crosstie to the inside walls of the housing in front of the bottom plate, wherein the flange apertures and the crosstie apertures are in substantial alignment to receive at least one concealable housing fastener when the housing is slidably received by the mounting bracket.

14. A method according to claim 13, wherein the bracket lock is further provided by:

attaching a hinge to the lockable door and the crosstie along the front of the housing.

15. A method according to claim 12, further comprising wherein the bracket lock is provided by:

attaching at least one spring-loaded tab on a fixed end to an upper surface of the mounting bracket and comprising a nub formed on a free end; and forming at least one aperture in the bottom plate, wherein the spring-loaded tab nub and the bottom plate aperture are in substantial alignment when the housing is slidably received by the mounting bracket.

16. A method according to claim 12, further comprising wherein the bracket lock is provided by:

attaching at least one spring-loaded tab attached on a fixed end to a bottom surface of the bottom plate and comprising a nub formed on a free end; and forming at least one notch formed in an upper surface of the mounting bracket, wherein the spring-loaded tab nub and the mounting bracket notch are in substantial alignment when the housing is slidably received by the mounting bracket.

17. A method according to claim 12, further comprising:

forming a pair of housing guides on the bottom margins to face inwards and run perpendicular to the bottom edges of the housing;

forming a pair of bottom plate guides on bottom edges of the bottom plate to face inwards and run perpendicular to outside edges of the bottom plate; and defining a pair of parallel channels, which comprises the bracket mount, between each of the housing guides and bottom plate guides and sized to slidably receive the mounting bracket.

18. A method according to claim 12, further comprising:

forming a pair of housing guides, which comprises the bracket mount, on the bottom margins to face inwards and run perpendicular to the bottom edges of the housing; and forming a pair of parallel channels on the outside edges of the mounting bracket and sized to slidably receive the housing guides.

19. A method according to claim 12, further comprising:

forming a pair of parallel C-shaped channel guides, which comprises the bracket mount, on a bottom surface of the bottom plate to face inwards; and forming a T-shaped guide on the mounting bracket, wherein the C-shaped channel guides are sized to slidably receive the T-shaped guide.

20. A method according to claim 12, further comprising:

forming a T-shaped guide, which comprises the bracket mount, on a bottom surface of the bottom plate; and forming a pair of parallel C-shaped channel guides on the mounting bracket to face inwards, wherein the T-shaped guide is sized to slidably receive the C-shaped channel guides.

21. A method according to claim 12, further comprising:

pivotably attaching a non-lockable door to the front of the housing.

22. A method according to claim 21, further comprising:

providing a shelf comprising a substantially level surface and sized to fixedly fit within the housing juxtapositioned to the non-lockable door.

23. A mounting bracket for a theft-resistant mailbox, comprising:

a mounting bracket assembly comprising a substantially flat plate provided with one or more apertures to accommodate at least one concealable post fastener, wherein the mounting bracket assembly slidably receives a pair of parallel housing channels, which comprises a bracket mount, provided on a mailbox housing; and a bracket lock to removably lock the mounting bracket assembly to the housing from at least one fixed point of attachment accessible from within the housing.

24. A mounting bracket according to claim 23, wherein the bracket lock comprises:

a perpendicular flange formed on a leading edge of the mounting bracket assembly with one or more flange apertures, wherein the flange apertures are in substantial alignment with crosstie apertures provided on the mailbox housing to receive at least one concealable housing fastener when the mailbox housing is slidably received by the mounting bracket assembly.

25. A mounting bracket according to claim 23, wherein the bracket lock comprises:

at least one spring-loaded tab attached on a fixed end to an upper surface of the mounting bracket assembly and comprising a nub formed on a free end, wherein the spring-loaded tab nub is in substantial alignment with an aperture provided on the mailbox housing when the mailbox housing is slidably received by the mounting bracket assembly.

26. A mounting bracket according to claim 23, wherein the bracket lock comprises:

at least one spring-loaded tab attached on a fixed end to a bottom surface of the mailbox housing and comprising a nub formed on a free end, wherein the spring-loaded tab nub is in substantial alignment with a notch provided on the mounting bracket assembly when the mailbox housing is slidably received by the mounting bracket assembly.

27. A mounting bracket for a theft-resistant mailbox, comprising:

a mounting bracket assembly comprising a substantially flat plate provided with one or more apertures to accommodate at least one concealable post fastener;

a pair of parallel channels formed on outside edges of the mounting bracket assembly which slidably receives a mailbox housing over the post fastener; and a bracket lock to removably lock the mounting bracket assembly to the housing from at least one fixed point of attachment accessible from within the housing.

28. A mounting bracket for a theft-resistant mailbox, comprising:

a mounting bracket assembly comprising a substantially flat plate provided with one or more apertures to accommodate at least one concealable post fastener;

a T-shaped guide formed on the mounting bracket assembly, wherein the T-shaped guide slidably receives a mailbox housing over the post fastener; and a bracket lock to removably lock the mounting bracket assembly to the housing from at least one fixed point of attachment accessible from within the housing.

29. A mounting bracket for a theft-resistant mailbox, comprising:

a mounting bracket assembly comprising a substantially flat plate provided with one or more apertures to accommodate at least one concealable post fastener;

a pair of parallel C-shaped channel guides formed on the mounting bracket assembly, wherein the C-shaped channel guides slidably receive a mailbox housing over the post fastener; and a bracket lock to removably lock the mounting bracket assembly to the housing from at least one fixed point of attachment accessible from within the housing.

30. A method for constructing a mounting bracket for a theft-resistant mailbox, comprising:

building a mounting bracket assembly comprising a substantially flat plate provided with one or more apertures to accommodate at least one concealable post fastener, wherein the mounting bracket assembly slidably receives a pair of parallel housing channels, which comprises a bracket mount, provided on a mailbox housing; and attaching a bracket lock to removably lock the mounting bracket assembly to the housing from at least one fixed point of attachment accessible from within the housing.

31. A method according to claim 30, further comprising:

forming a perpendicular flange on a leading edge of the mounting bracket assembly with one or more flange apertures, wherein the flange apertures are in substantial alignment with crosstie apertures provided on the mailbox housing to receive at least one concealable housing fastener when the mailbox housing is slidably received by the mounting bracket assembly.

32. A method according to claim 30, further comprising:

attaching at least one spring-loaded tab on a fixed end to an upper surface of the mounting bracket assembly and forming a nub on a free end, wherein the spring-loaded tab nub is in substantial alignment with an aperture provided on the mailbox housing when the mailbox housing is slidably received by the mounting bracket assembly.

33. A method according to claim 30, further comprising:

attaching at least one spring-loaded tab attached on a fixed end to a bottom surface of the mailbox housing and comprising a nub formed on a free end, wherein the spring-loaded tab nub is in substantial alignment with an notch provided on the mounting bracket assembly when the mailbox housing is slidably received by the mounting bracket assembly.

34. A method for constructing a mounting bracket for a theft-resistant mailbox, comprising:

building a mounting bracket assembly comprising a substantially flat plate provided with one or more apertures to accommodate at least one concealable post fastener;

forming a pair of parallel channels on the outside edges of the mounting bracket assembly which slidably receive a mailbox housing over the post fastener; and attaching a bracket lock to removably lock the mounting bracket assembly to the housing from at least one fixed point of attachment accessible from within the housing.

35. A method for constructing a mounting bracket for a theft-resistant mailbox, comprising:

building a mounting bracket assembly comprising a substantially flat plate provided with one or more apertures to accommodate at least one concealable post fastener;

forming a T-shaped guide on the mounting bracket assembly, wherein the T-shaped guide slidably receives a mailbox housing over the post fastener; and attaching a bracket lock to removably lock the mounting bracket assembly to the housing from at least one fixed point of attachment accessible from within the housing.

36. A method for constructing a mounting bracket for a theft-resistant mailbox, comprising:

building a mounting bracket assembly comprising a substantially flat plate provided with one or more apertures to accommodate at least one concealable post fastener;

forming a pair of parallel C-shaped channel guides on the mounting bracket assembly, wherein the C-shaped channel guides slidably receive a mailbox housing over the post fastener; and attaching a bracket lock to removably lock the mounting bracket assembly to the housing from at least one fixed point of attachment accessible from within the housing.

* * * * *